United States Patent [19]

Rissman et al.

[11] Patent Number: 4,813,907

[45] **Date of Patent: * Mar. 21, 1989**

[54] TOY VEHICLE WITH GRAPHICS DISPLAY

[75] Inventors: Owen R. Rissman, Northbrook, Ill.; Henry T. Ho Tai, Chaiwan, Hong Kong

[73] Assignee: Tiger Electronic Sales, Ltd., Hong Kong

[ * ] Notice: The portion of the term of this patent subsequent to Feb. 7, 2006 has been disclaimed.

[21] Appl. No.: 93,958

[22] Filed: Sep. 8, 1987

Related U.S. Application Data

[63] Continuation-in-part of Ser. No. 859,699, May 5, 1986.

[51] Int. Cl.[4] ..... A63H 17/00; A63H 17/28

[52] U.S. Cl. ..... 446/175; 446/267; 446/295; 446/409; 446/438

[58] Field of Search ..... 446/175, 267, 295, 303, 446/438, 441, 457, 462, 472; 434/66, 67, 69; 273/1 E, 85 G; 340/715, 784

[56] References Cited

U.S. PATENT DOCUMENTS

| | | | |
|---|---|---|---|
| 4,201,012 | 5/1980 | Marshall | 446/175 |
| 4,221,927 | 9/1980 | Dankman et al. | 446/297 X |
| 4,314,423 | 2/1982 | Lipsitz et al. | 43/3 X |
| 4,347,683 | 9/1982 | Maxim | 446/462 X |
| 4,472,905 | 9/1984 | Silverman et al. | 446/462 X |
| 4,476,648 | 10/1984 | Maxim | 446/462 X |
| 4,501,569 | 2/1985 | Clark, Jr. et al. | 446/460 X |
| 4,540,176 | 9/1985 | Baer | 446/302 X |
| 4,559,022 | 12/1985 | Herstein et al. | 446/438 |
| 4,642,710 | 2/1987 | Murtha et al. | 446/175 X |
| 4,658,928 | 4/1987 | Seo | 446/454 X |

FOREIGN PATENT DOCUMENTS

| | | | |
|---|---|---|---|
| 2058589 | 4/1981 | United Kingdom | 446/175 |
| 2151494 | 7/1985 | United Kingdom | 446/438 |

*Primary Examiner*—Robert A. Hafer
*Assistant Examiner*—Charles H. Harris
*Attorney, Agent, or Firm*—Dressler, Goldsmith, Shore, Sutker & Milnamow, Ltd.

[57] ABSTRACT

A toy vehicle construction is disclosed which has been particularly configured so that the toy vehicle exhibits animated characteristics. To this end, a liquid crystal graphics display is provided on the chassis of the vehicle, with the graphics display particularly configured to display a plurality of simulated life functions. An associated micro-processor effects operation and control of the graphics display, with additional sound-generating, light-emitting, and detecting devices further provided to further lend to the animated nature of the device.

4 Claims, 2 Drawing Sheets

TOY VEHICLE WITH GRAPHICS DISPLAY

CROSS-REFERENCE TO RELATED APPLICATION

This is a continuation-in-part of U.S. application Ser. No. 859,699, filed May 5, 1986.

TECHNICAL FIELD

The present invention relates generally to toy vehicles, and more particularly to a toy vehicle having a liquid crystal graphics display which is configured and operated to lend animated characteristics to the toy vehicle construction.

BACKGROUND OF THE INVENTION

For many years, children have enjoyed toys having adventure-oriented themes, such as toy soldiers and warriors, and associated toy vehicles and aircraft. Children frequently play with such toys by engaging in mock combat and battles, and other like adventures.

More recently, doll-like toys of this nature have been configured to resemble television and motion picture characters as depicted in both animated and filmed features. Again, these types of toys are frequently based on adventure-oriented themes, and are therefore sometimes referred to as "action" toys.

Above-referenced parent patent application Ser. No. 859,699 discloses a human-like action figure toy of the above type, which, in order to enhance its entertainment value, is provided with a liquid crystal graphics display. Notably, the graphics display is configured to depict a plurality of simulated life functions for the toy figure, thus lending animated characteristics to the figure for enhanced entertainment.

As will be appreciated, toys which exhibit animated characteristics provide children with additional entertainment and stimulation beyond the more typical, inanimate toy constructions. Accordingly, and in keeping with the general theme of the above-referenced parent patent application, the present invention contemplates a toy vehicle construction having animated characteristics.

SUMMARY OF THE INVENTION

A toy vehicle construction in accordance with the present invention includes an external liquid crystal graphics display configured to display a plurality of simulated life functions. An associated micro-processor operatively connected with the display effects control and operation thereof, and permits the graphics display to be operated to show different levels of animation, different activities, as well as additional features. Thus, the toy vehicle is provided with animated characteristics for enhanced entertainment, and can be readily configured for various types of interaction with a child, as well as with other similar related toys.

While the precise configuration of a toy vehicle embodying the present invention can be widely varied, the illustrated embodiment includes a toy vehicle chassis having a generally futuristic appearance. This preferred configuration is not only in keeping with the technically-advanced nature of the toy, but is in further keeping with the popularity which outer space related games and toys are enjoying. Additionally, a number of toys which are currently popular comprise toy vehicles which possess humanoid or robotic characteristics.

In accordance with the present invention, the present toy construction includes a preferably liquid crystal graphics display mounted on the toy vehicle chassis. Notably, the graphics display is configured to display a plurality of simulated life functions, and is further preferably configured to display such life functions in a plurality of modes or levels of activity. Thus, not only does the graphics display lend animated characteristics to the toy construction, but the play value of the toy is further enhanced by permitting children to affect the level of animation in accordance with related play activities.

Operation and control of the graphics display is effected by suitable electronic control means, such as a micro-processor operatively connected to the display. Suitable programming of the micro-processor effects the desired operation of the graphics display whereby the toy vehicle construction exhibits the desired animation.

In accordance with the illustrated embodiment, at least one, and preferably a plurality, of switch devices are provided on the toy vehicle chassis, and are operatively connected to the micro-processor. The switch or switches are arranged to effect operation of the graphics display, and can be further arranged to alter the activities shown by the display. In addition to normal manually operable switches, use of motion-sensitive switching devices, such as operatively associated with the vehicle wheels, is also contemplated.

Additional features of the construction further lend to animation of the toy vehicle. To this end, the toy vehicle can include a switching device in the form of a light-sensor mounted on the toy vehicle chassis and operatively connected to the micro-processor. The light-sensor and micro-processor can be suitably arranged and programmed so that the graphics display of the vehicle is operated responsively to light signals (including normal "white" light, as well as light of other wavelengths, such as infrared) which are received by the light sensor. In the illustrated embodiment, the graphics display is configured to include a target indicator which is operated in response to the light sensor receiving predetermined light signals. Thus, the toy vehicle can receive light signals from a mock "laser beam" weapon or the like, and graphically respond to the signals.

Similarly, the toy vehicle is preferably provided with a sound generator operatively connected to the micro-processor of the toy for generating sound in coordination with operation of the liquid crystal graphics display. Again, the animated characteristics of the vehicle are enhanced by the generation of sound attendant to its operation.

Other features and advantages of the present invention will become readily apparent from the following detailed description, the accompanying drawings, and the appended claims.

DETAILED DESCRIPTION

Figure 1:
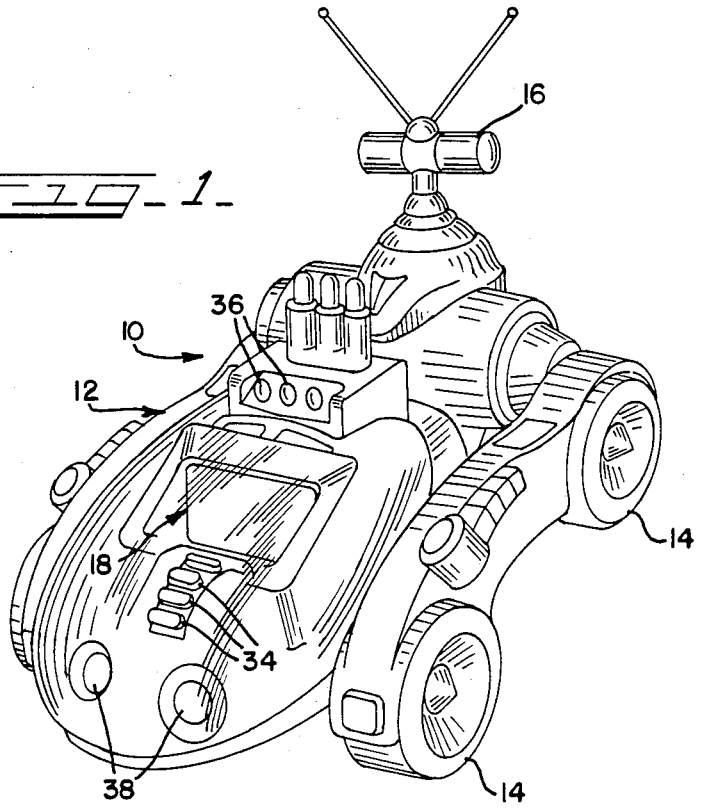
FIG. 1 is a front perspective view of a toy vehicle construction having a liquid crystal graphics display embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated a toy vehicle construction 10 embodying the principles of the present invention. While the precise configuration of the toy vehicle 10 can be widely varied while keeping with the principles disclosed herein, it is contemplated that the vehicle comprise a toy vehicle chassis 12, which may be of a wheeled configuration such as by including suitable wheels 14. In keeping with the adventure-oriented nature of the toy, the vehicle chassis may be configured to include mock radar/communication gear 16, as well as other integral features of a technical or futuristic nature.

Figure 2:
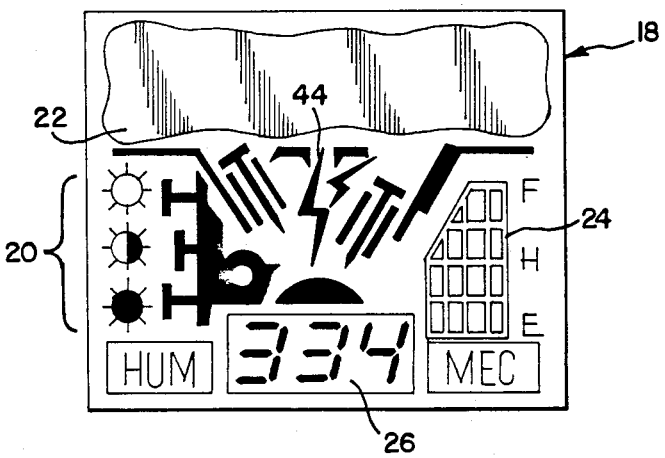
FIG. 2 is a detailed showing of the liquid crystal graphics display shown on the toy vehicle of FIG. 1, with the display configured to lend animated characteristics to the toy vehicle.

In accordance with the principles of the present invention, vehicle 10 includes a preferably liquid crystal graphics display 18 mounted on the vehicle chassis 12. Preferred features of the graphics display 18 are shown in an illustrative form of the display in FIG. 2. Specifically, the graphics display preferably includes a plurality of activity mode indicators 20 which can be operated to designate different levels or modes of animation (i.e., a "rest" mode, a "combat" mode, etc.). Similarly, a graphic activity indicator 22 is provided, which may include movable graphic elements to denote animated characteristics.

In order to further lend animated characteristics to the toy vehicle construction, the graphics display 18 preferably includes a graphic display 24 such as for indicating the "energy level" (i.e., "fuel reserves" ) of the toy vehicle. The animated features of the toy vehicle can further be provided via a digital display 26 which may be numeric or alphanumeric in nature.

Figure 3:
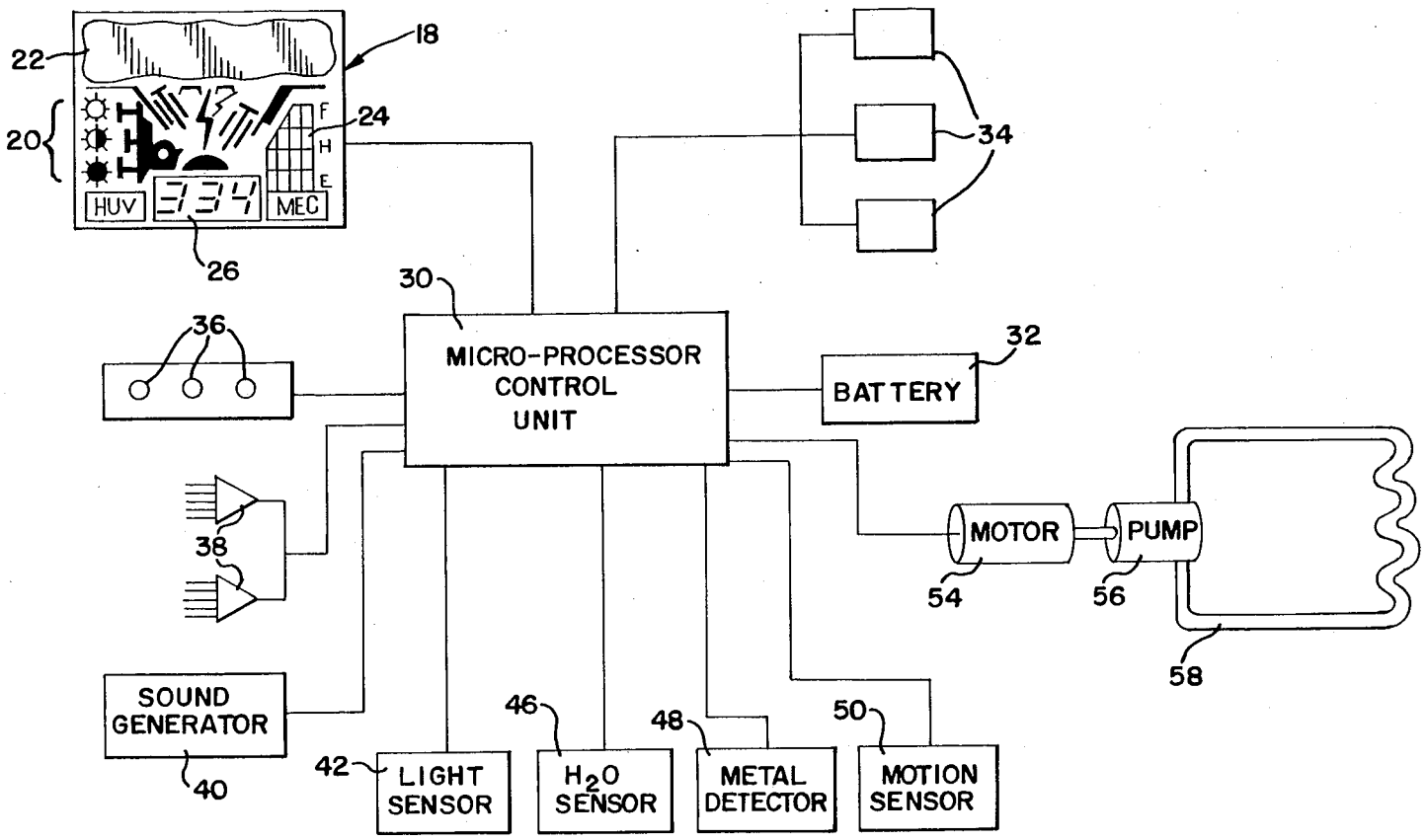
FIG. 3 is a diagrammatic view of various operative components of the present toy vehicle construction.

With further reference to FIG. 3, therein is shown a diagrammatic illustration of the graphics display 18 and its associated components. Control and operation of the graphics display is effected by suitable electronic controls, such as micro-processor control unit 30 with which the display is operatively connected. A suitable battery 32 operatively connected with the circuitry provides power for the micro-processor and the display, as well as for the related electrical components of the construction.

One or more selectively operable switches 34, which can be mounted on the vehicle chassis 12 for convenient manipulation (see FIG. 1), are operatively connected with the micro-processor 30 whereby the simulated life functions shown on the graphics display 18 can be operated and controlled. In addition, such switches can be provided in the form of motion-sensitive devices or the like operatively associated with the vehicle wheels or other components of the construction. Thus, the vehicle may be configured such that rolling movement, or other manipulation, effects operation of the control unit 30 and the graphics display 18.

In keeping with the animated nature of the present toy vehicle construction, it is preferred that a plurality of light-emitting diodes 36 be provided on the vehicle chassis 12, with the diodes operatively connected with the micro-processor 30 whereby the diodes can flash or blink to show animation. Similarly, the toy vehicle construction can be provided with electrical headlamps 38 which are also controlled via the micro-processor in response to appropriate inputs.

The preferred provision of a sound generator 40 in operative connection with the micro-processor 30 significantly enhances the animated characteristics of the toy vehicle construction. The sound generator 40 is preferably operated by the micro-processor in coordination with operation of the graphics display 18, whereby different sounds are generated attendant to display of various simulated life functions. Likewise, control inputs to the micro-processor via switches 34 can be audibly registered through operation of the sound generator.

Depending upon the type of play activities for which the toy vehicle construction 10 is intended, the toy vehicle can be provided with one or more sensor or detector devices. To this end, a switch device in the form of a light sensor 42 is preferably provided which is operatively connected to the micro-processor 30 whereby the toy vehicle construction can function in response to light inputs. Depending upon the precise operational characteristics which are desired, a light sensor responsive to either normal "white" light, or infrared wavelengths, can be employed.

Light inputs to sensor 42 can be used to create a variety of different effects. For example, the graphics display 18 may be provided with a suitable target indicator 44 or the like (see FIG. 2), with the indicator 44 operatively connected with the light sensor 42 via the micro-processor for indicating input of predetermined signals to the light sensor. Thus, the toy vehicle can be arranged to respond to combat with a mock "laser beam" weapon or the like.

Switches in the form of other types of sensing devices can be further provided depending upon the desired animated characteristics of the toy vehicle. For example, a water sensor 46, metal detector 48, and motion detector 50 can be provided in operative connection with the micro-processor control unit 30 whereby the toy vehicle responds to inputs to these sensors. As will be appreciated, the provision of sensors of this nature provide the toy vehicle with a level of sophistication for highly stimulating and entertaining play activity.

Further animation of the toy vehicle construction 10 can be achieved by the provision of a suitable electric motor 54 in operative connection with the micro-processor 30. For example, it is contemplated that the electric motor 54 be operatively connected with suitable movable mechanical components of the toy vehicle chassis 12 to impart a rhythmic motion to the chassis components such that the toy vehicle appears to "breathe". In the illustrated embodiment, shown diagrammatically in FIG. 3, electric motor 54 is operatively connected with a suitable liquid pump 56, which in turn is operatively associated with a liquid conduit 58 through which the pump moves liquid to lend an appearance of circulating "blood" or other vital fluid.

Thus, a novel toy vehicle construction is disclosed which is particularly configured to exhibit animated characteristics for the entertainment and stimulation of children. The provision of a liquid crystal graphics display provides the toy vehicle with simulated life functions, with the provision of various light detecting and sound generating devices further lending animated characteristics to the toy construction.

From the foregoing, it will be observed that numerous modifications and variations can be effected without departing from the true spirit and scope of the novel concept of the present invention. It is to be understood that no limitation with respect to the specific embodiment is intended or should be inferred. It is, of course, intended to cover by the appended claims all such modifications as fall within the scope of the claims.

What is claimed is:

1. A toy vehicle construction having animated characteristics, comprising:

a toy vehicle chassis;

graphics display means mounted on said toy vehicle chassis and comprising a liquid crystal graphics display, said graphics display being configured to display a plurality of simulated life functions to lend animated characteristics to said toy vehicle construction;

control means operatively connected to said graphics display means for effecting operation and control thereof, including variations in said simulated life functions displayed by said graphics display means; and at least one switch means on said toy vehicle chassis, said switch means being operably connected to said control means for effecting control of the simulated life functions shown by said graphics display means, said switch means including light-sensor means operatively connected to said control means for receiving light signals, said graphics display means including target indicator means operated in response to said light-sensor means receiving predetermined light signals.

2. A toy vehicle construction in accordance with claim 1, including sound generator means operatively connected to said control means for generation of sound in coordination with operation of said graphics display means displaying said simulated life functions.

3. A toy vehicle construction in accordance with claim 1, including electric motor means operatively connected to said control means, said motor means being further operatively connected with life simulating means on said toy vehicle chassis for simulating life functions.

4. A toy vehicle construction in accordance with claim 3, wherein said life simulating means comprises liquid pump means and operatively associated liquid conduit means through which liquid is pumped when said motor means operatesd said pump means.

* * * * *